US005890629A

United States Patent [19]

Loew

[11] Patent Number: 5,890,629

[45] Date of Patent: Apr. 6, 1999

[54] APPARATUS FOR DISPENSING BEVERAGES

[75] Inventor: Jonathon Loew, East Meadow, N.Y.

[73] Assignee: Design Display Group, Inc., Carlstadt, N.J.

[21] Appl. No.: 935,068

[22] Filed: Sep. 25, 1997

[51] Int. Cl.[6] ..... B67D 5/60; B67D 5/62

[52] U.S. Cl. ..... 222/144.5; 222/144; 222/146.6

[58] Field of Search ..... 222/144, 144.5, 222/146.6

[56] References Cited

U.S. PATENT DOCUMENTS

| | | | |
|---|---|---|---|
| 128,956 | 7/1872 | Fellows | 222/144 |
| 677,751 | 7/1901 | Baron | 222/144 |
| 912,281 | 2/1909 | Brunner et al. | 222/144 |
| 2,868,416 | 1/1959 | Smith | 222/146 |
| 3,200,994 | 8/1965 | Levinson et al. | 222/82 |
| 3,598,287 | 8/1971 | de Man | 222/64 |
| 3,698,603 | 10/1972 | Radcliffe | 222/146 R |
| 3,930,598 | 1/1976 | Slagle | 22/129.4 |
| 4,133,456 | 1/1979 | Corini | 222/146 |
| 4,836,414 | 6/1989 | Credle, Jr. et al. | 222/1 |
| 4,932,561 | 6/1990 | Boxall | 222/54 |
| 5,065,905 | 11/1991 | Eddy et al. | 222/132 |
| 5,209,069 | 5/1993 | Newnan | 62/3.64 |
| 5,351,861 | 10/1994 | Jovellana | 222/144 |
| 5,494,195 | 2/1996 | Knuettel, II et al. | 222/146.6 |

*Primary Examiner*—Andres Kashnikow
*Assistant Examiner*—Kents Quinalty
*Attorney, Agent, or Firm*—Steinberg & Raskin, P.C.

[57] ABSTRACT

Apparatus for dispensing beverages from containers including a housing having an outer surface, canisters arranged in the housing for defining compartments in which beverages from the beverage containers are received, one in each compartment, spigots mounted on the outer surface of the housing and arranged in flow communication with the compartments for enabling individual dispensing of the beverages from the compartments, and a single thermoelectric unit for cooling or heating the beverages received in all of the compartments. The thermoelectric unit has a first conductor plate thermally coupled to the canisters, a second conductor plate spaced from the first conductor plate and thermally isolated from the canisters and at least one thermocouple arranged between the first and second conductor plates. Each thermocouple includes a pair of semi-conductor elements made from a semi-conductor material. In use, upon the application of a voltage to the thermocouple(s), the first conductor plate is cooled and thus the canisters and the beverages contained therein are cooled, and the second conductor plate is heated or vice versa. A thermal sink member made of a thermal-conductive material is interposed between the canisters and the first conductor plate and includes a plurality of concavities around an outer circumference thereof, each receivable of a canister. An upper wall of the housing defines a plurality of bottle-receiving recesses, each situated over one canister. The beverage containers are mounted in an inverted position in the recesses such that the beverages flow into the canisters and may be dispensed through the spigots after being cooled or heated by the thermoelectric unit.

28 Claims, 5 Drawing Sheets

APPARATUS FOR DISPENSING BEVERAGES

FIELD OF THE INVENTION

The present invention relates generally to apparatus for dispensing beverages from a number of containers or bottles whereby the beverages are chilled or heated prior to dispensing, and more particularly to apparatus for individually dispensing different liquors which are chilled prior to dispensing.

BACKGROUND OF THE INVENTION

Nowadays, liquor is often bottled in distinctively designed and labeled bottles and specialized dispensing apparatus are often used in bars to dispense the liquor. To increase the visibility of the distinctive liquor bottles and facilitate the dispensing of the liquor contained in them, the bottles are often inverted, or inclined, and mounted in the apparatus which is then placed in locations so that it and the bottles mounted therein are readily visible to the consuming public, e.g., on bar counters. In use, the liquor flows from the bottles into the apparatus and specifically into connection with a refrigeration unit in the apparatus and is cooled to a desired dispensing temperature by the refrigeration unit prior to being dispensed from the apparatus.

Apparatus of this type often use conventional refrigeration systems to cool the liquor to the desired dispensing temperature. However, the use of such conventional refrigeration systems presents certain drawbacks, most notably the fact that these systems are bulky and relatively inefficient since they require numerous components such as a compressor, refrigerator coil, condenser, pump, fan and other associated refrigeration equipment, all of which are subject to wear and tear.

To overcome these drawbacks, thermoelectric cooling is now used in some apparatus to cool the liquor in a manner similar to thermoelectrically-cooled water coolers. Thermoelectric cooling provides a more efficient cooling of the liquor with a minimum of components in a compact space. Generally, a thermoelectric cooling unit includes at least one pair of elements made of a semi-conductor material coupled together at junctions at each end, such as by means of a respective electrical conductor. A pair of semi-conductor elements coupled together in this manner is often called a "thermocouple". The application of low-voltage direct current to the semi-conductor elements results in the cooling of one of the junctions and the heating of the other junction, i.e., the conductor comprising one junction coupling first ends of the semiconductor elements will be heated while the conductor comprising the other junction coupling second, opposed ends of the semiconductor elements will be cooled.

In prior art beverage dispensing apparatus that utilize thermoelectric cooling, for each beverage to be cooled, there is at least one dedicated thermoelectric cooling unit comprising one or more thermocouples. It is a serious disadvantage of such apparatus that thermoelectric cooling units are quite expensive and the use of several such units in a single apparatus makes the cost of such an apparatus quite prohibitive. Another design of an apparatus for dispensing chilled beverages utilizing thermoelectric cooling is shown in U.S. Pat. No. 5,494,195 (Knuettel, II) and includes a single thermoelectric cooling unit comprising a plurality of thermocouples for cooling the beverages. The dispensing apparatus accommodates several bottles and includes a single beverage outlet faucet. Separate flow-dispensing paths are provided for each beverage, each of which passes through a common thermoelectric cooling unit so that during dispensing, each beverage will pass through the common thermoelectric cooling unit to the outlet faucet. Thus, Knuettel avoids the expense of having separate thermoelectric cooling units for each beverage by providing a system for passing the beverages through the common thermoelectric cooling unit to maximize the use thereof However, since all of the beverages flow through the same passage in the common thermoelectric cooling unit during dispensing, a beverage being dispensed at any given moment may mix with residual amounts of other beverages previously dispensed thereby altering the taste of the beverage being dispensed at that moment.

Further, U.S. Pat. No. 5,209,069 (Newnan) describes a compact, thermoelectrically cooled beverage dispenser which in certain configurations includes two beverage receptacles, and two thermoelectric cooling assemblies, each for cooling a respective beverage receptacle. Each thermoelectric cooling assembly includes a pair of conductor plates made of thermally conductive material, a first one situated proximate to the beverage receptacles and a second one spaced from the first, and several thermocouples arranged between the conductor plates. When a voltage is applied to the thermocouples, the first conductor plates proximate the beverage receptacles are cooled and the second conductor plates are heated. It is a disadvantage of this construction in that it requires a separate thermoelectric cooling unit for each beverage receptacle thereby increasing the cost of this beverage dispensing apparatus. With respect to the use of a single heating or cooling unit for heating or cooling several liquids in individual compartments, reference is made to U.S. Pat. No. 2,868,416 (Smith) which describes an apparatus for heating hair shampoo and other hair and scalp-treatment liquids in which electric heating coils extend beneath a number of liquid-receivable compartments, each of which has a separate dispensing nozzle. In operation, the electric heating coils heat the liquid in all of the compartments.

OBJECTS AND SUMMARY OF THE INVENTION

It is an object of the present invention to provide a new and improved apparatus for dispensing beverages from separate bottles.

It is another object of the present invention to provide a new and improved apparatus for dispensing beverages from several bottles in which the beverages from all of the bottles can be cooled or heated more efficiently than in prior art beverage dispensing apparatus.

It is a further object of the present invention to provide a new and improved apparatus for dispensing beverages from several bottles in which the beverages from all of the bottles can be cooled or heated prior to dispensing by means of a single thermoelectric unit comprising one or more thermocouples.

In view of achieving these objects and others, one embodiment of the apparatus in accordance with the invention comprises a substantially cylindrical housing including means forming separated compartments, mounting means for mounting beverage containers or bottles in flow communication with a respective compartment, a separate dispensing nozzle arranged in flow communication with each respective compartment for enabling individual dispensing of the beverage therefrom and a single thermoelectric unit for simultaneously cooling or heating the beverages received in all of the compartments. The thermoelectric unit for the purposes herein includes a pair of conductor plates, a first conductor plate thermally coupled to the compartment-forming means and a second conductor plate spaced from the first conductor plate and thermally isolated from the compartment-forming means, and one or more thermocouples interposed between the first and second conductor plates, each thermocouple comprising a pair of semiconductor elements. When a voltage is applied to the thermocouple (s), one conductor plate is cooled and the other conductor plate is heated.

The thermoelectric unit in the invention may have two modes of operation depending on the current path through the thermocouples, a cooling mode of operation in which the beverages are cooled or a heating mode of operation in which the beverages are heated. In the cooling mode of operation, when a voltage is applied to the thermoelectric unit, and more specifically to the thermocouple(s) therein, heat is drawn or pumped to the second conductor plate from the first conductor plate (which is situated proximate to the beverage-containing compartments in heat-exchange relationship, i.e, thermally coupled, thereto) so that the first conductor plate is cooled. In view of the thermal coupling of the first conductor plate to the beverage compartment-forming means, heat is drawn from the compartment-forming means through any intermediate thermal-conducting structural element(s) interposed between the first conductor plate and the compartment-forming means so that the compartment-forming means are cooled and thus the beverages in the compartments are cooled. The heat at the second conductor plate is drawn off therefrom by a ventilation fan. After application of the voltage to the thermoelectric unit for a certain period of time, i.e., until the intermediate thermal-conducting structural element(s) reach (es) a set temperature, the intermediate thermal-conducting structural element(s) may constitute a cold sink or reservoir in which case, continuous operation of the thermoelectric unit can be avoided. On the other hand, in the heating mode of operation, when a voltage is applied to the thermocouple (s) in the thermoelectric unit, heat is pumped from the second conductor plate to the first conductor plate situated proximate to the beverage-containing compartments so that the first conductor plate is heated. In view of the thermal coupling of the first conductor plate to the beverage compartment-forming means, the compartment-forming means, as well as the intermediate thermal-conducting structural element(s) interposed between the first conductor plate and the compartment-forming means, are heated so that the beverages in the compartments are heated. Once the thermal-conducting structural element(s) is/are heated to a set temperature, the intermediate thermal-conducting structural element(s) may constitute a heat sink so that the operation of the thermoelectric unit may be at least temporarily discontinued.

The mounting means in which the bottles are associated with the apparatus may comprise an upper transverse wall of the housing provided with recesses adapted to support the bottles, each leading into one of the compartments, such that the bottles may be placed into the recesses in an inverted position and the beverage in each bottle flows downward into the respective compartment.

In view of the fact that in accordance with one embodiment of the invention, there is only a single thermoelectric unit, i.e., one which has only two conductor plates which comprise the junctions coupling the ends of the thermocouple(s), the cost of the apparatus is considerably less than that of apparatus which use a number of such thermoelectric units, e.g., one unit for each beverage compartment. Nevertheless, the single thermoelectric unit is capable of cooling (or heating) the beverages in all of the compartments in view of the particular construction and interconnection of the compartment-forming means and an intermediate thermal-conducting thermal sink element interposed between the first conductor plate situated proximate the compartments and the compartment-forming means. To this end, in one exemplifying embodiment of apparatus in accordance with the invention, the compartment-forming means include a plurality of canisters made from a thermal-conductive material, preferably stainless steel, each defining one of the beverage-receiving compartments. The intermediate, thermal-conducting thermal sink element interposed between the canisters and the first conductor plate comprises a relatively massive thermal sink member made of thermal-conductive material, such as aluminum, and having a generally cylindrical body including a plurality of axially extending concavities formed around its circumference and a substantially circular base arranged at a lower edge of the cylindrical body and extending beyond the periphery of the cylindrical body. Each canister is supported on the base and thermally connected to the surface defining one of the concavities as well as the base.

To maximize the heat transfer between the first conductor plate situated proximate the canisters and the beverages in the canisters, i.e., the heating or cooling effect provided by the thermoelectric unit, the canisters are connected to the thermal sink member by thermo-conductive epoxy and the thermal sink member is also connected to the first conductor plate by thermo-conductive epoxy. Thermal insulation means, such as polyurethane foam, is arranged within the housing surrounding the thermal sink member and canisters to minimize the loss of thermal energy from the thermal sink member and the canisters and thus maximize the heat transfer between the first conductor plate situated proximate the canisters and the beverages in the canisters.

In order to enable the dissipation of the heat generated from the second conductor plate when the thermoelectric unit is operating in the cooling mode, ventilation means, such as a fan, direct air over the second conductor plate to carry away heat. To enable draining of the compartments for periodic cleaning thereof, each canister has an aperture formed in its bottom, a drain tube connected to the aperture of the canister and passing through an aperture in the base of the thermal sink member and a flow restrictor arranged in connection with the drain tube for preventing draining of the beverage from the compartments during dispensing of the beverage.

BRIEF DESCRIPTION OF THE DRAWINGS

A more complete appreciation of the present invention and many of the attendant advantages thereof will be readily understood by reference to the following detailed description when considered in connection with the accompanying drawings in which.

DETAILED DESCRIPTION OF THE PREFERRED EMBODIMENTS

Figure 1:
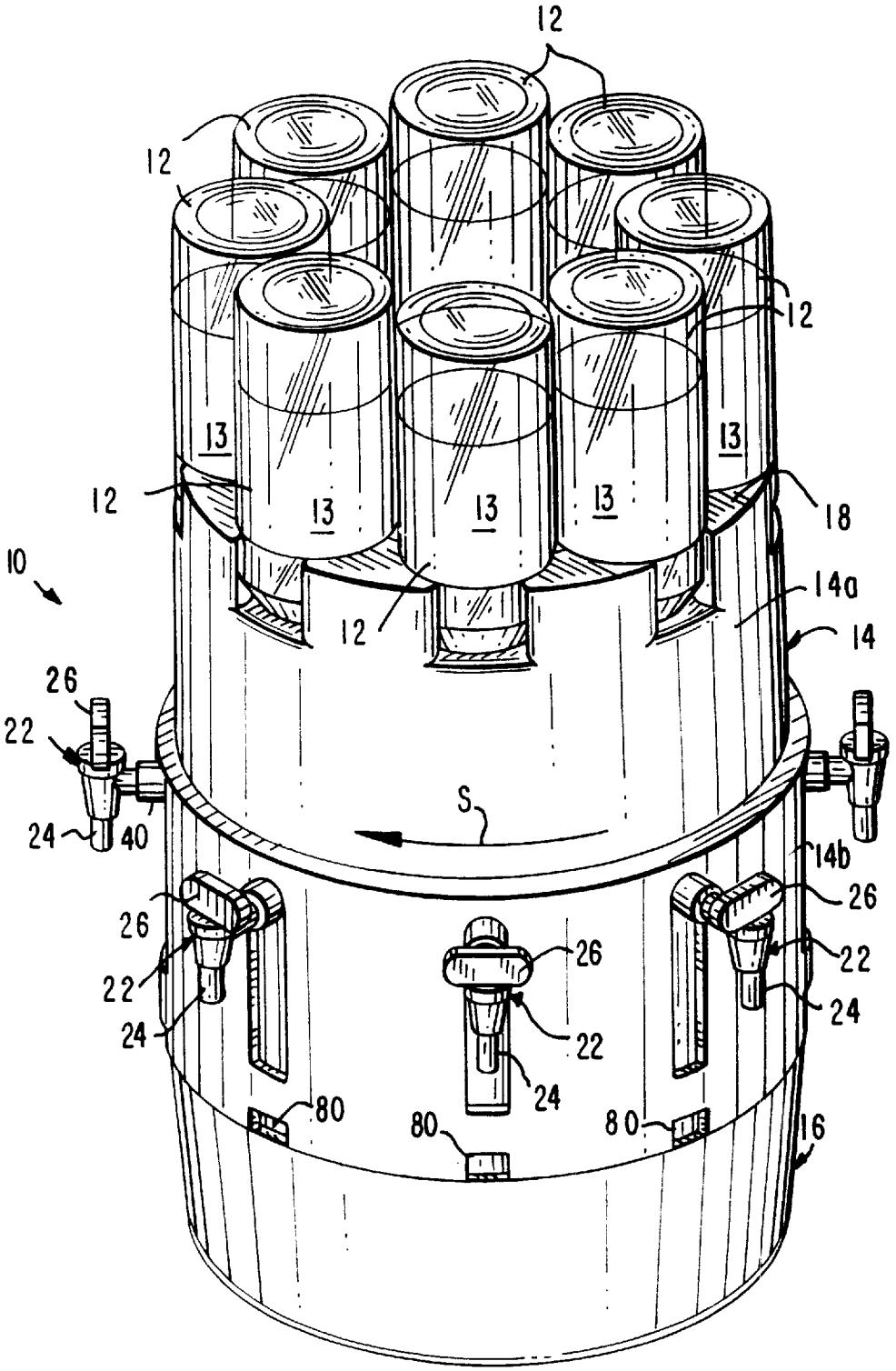
FIG. 1 is a perspective view of an apparatus for dispensing beverages in accordance with the invention.
Figure 2:
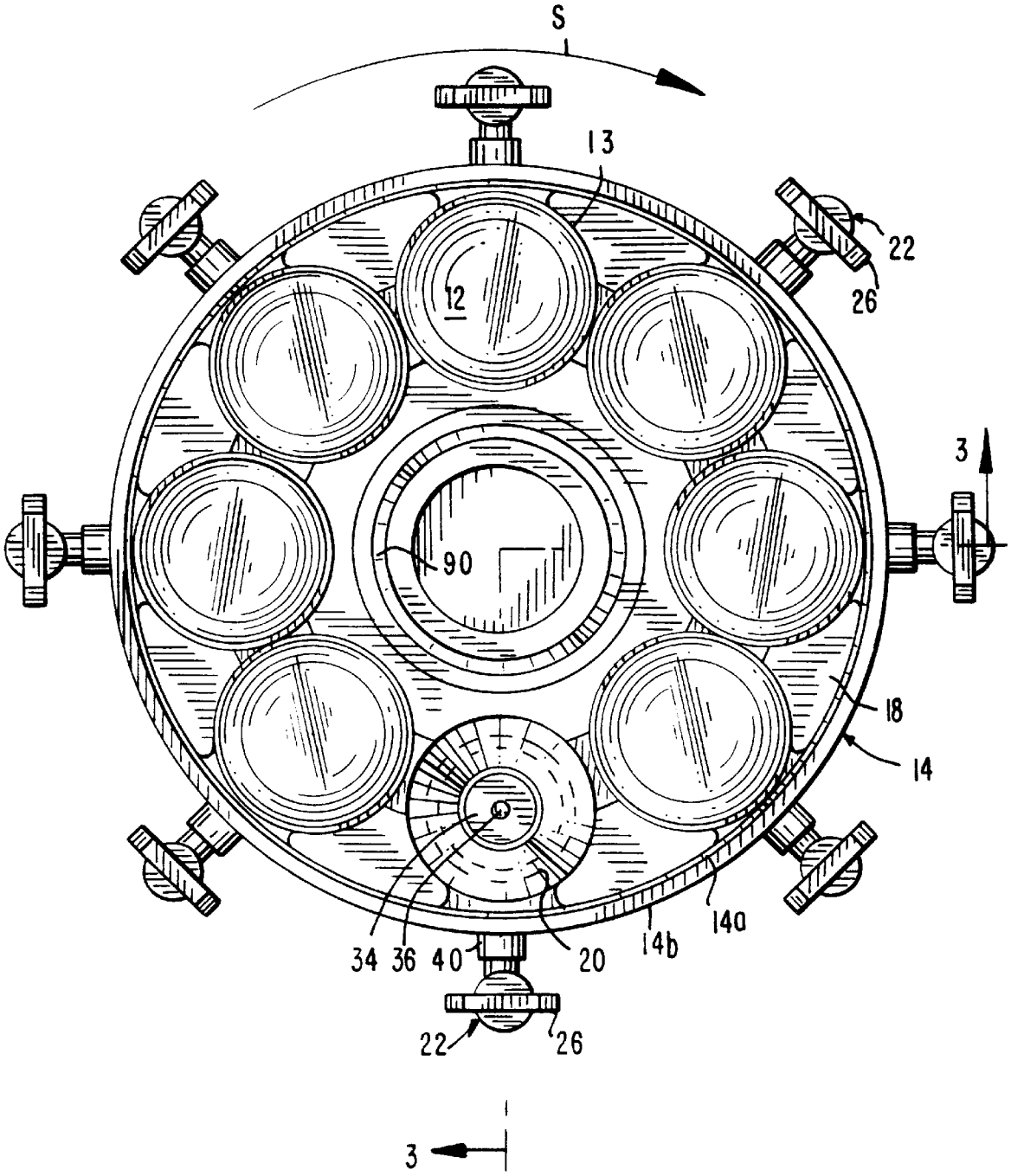
FIG. 2 is a top view of the apparatus for dispensing beverages shown in FIG. 1 with one of the bottles removed.

Referring to the accompanying drawings wherein like reference characters designate identical or corresponding parts throughout the several views, an apparatus for dispensing beverages in accordance with the present invention is designated generally 10 and is adapted to receive a plurality of beverage bottles or containers 12 in an inverted position, eight bottles 12 of beverage arranged in a substantially circular configuration and uniformly spaced from one another. The apparatus 10 includes a substantially cylindrical housing 14 rotatably mounted on a stationary base 16, the housing 14 being rotatable in the direction of arrow S with respect to the base 16. Housing 14 and base 16 are made of a hard plastic material or equivalent. The housing 14 has a first cylindrical section 14*a,* an adjacent second cylindrical section 14*b* and an upper transverse wall 18 arranged at an upper edge of the first cylindrical section 14*a*. The diameter of the second cylindrical section 14*b* is slightly larger than the diameter of the first cylindrical section 14*a*. The transverse wall 18 defines bottle-receiving recesses 20, each receiving one of the bottles 12. In a preferred mode of construction, the apparatus 10 is constructed as a table-top unit to be placed on tables, bar counters and the like and, accordingly, the base 16 includes a flat bottom surface.

Figure 3:
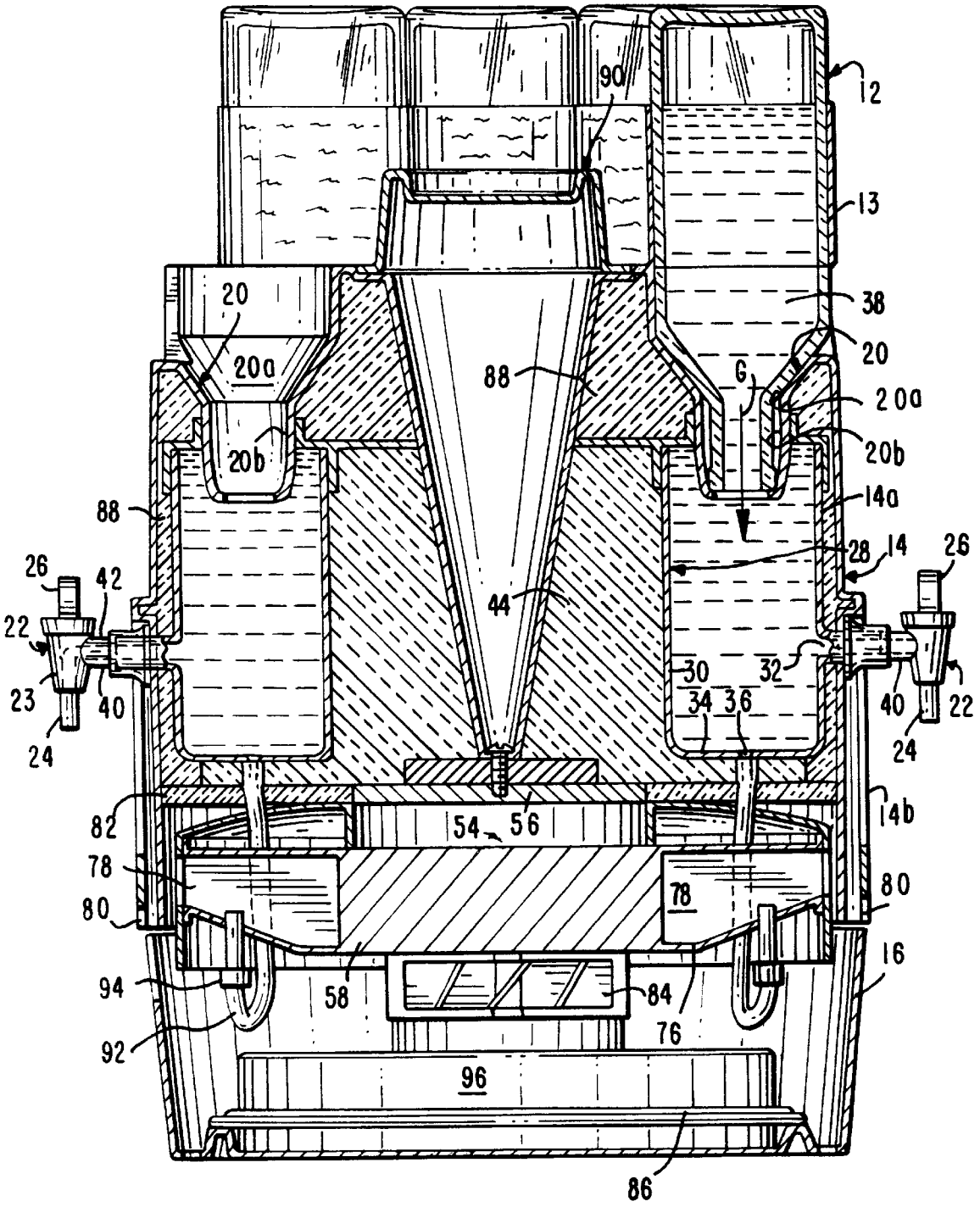
FIG. 3 is a sectional view of the apparatus for dispensing beverages shown in FIG. 1 taken along the line 3—3 in FIG. 2.

In order to securely retain the bottles 12 on the housing 14, the form of the recesses 20 is constructed to correspond to the shape of the upper part of the bottles 12 and thus, in the illustrated embodiment wherein the upper part of each bottle 12 has a conical section between the cylindrical body of the bottle and the cylindrical neck of the bottle, the recesses 20 each comprise a downwardly oriented truncated conical wall 20*a* and a tubular section 20*b* connecting to the lower edge of the conical wall 20*a* (FIG. 3). The recesses 20 are preferably constructed to support the bottles 12 so that no part of any distinctive label 13 (FIG. 3) of the bottles 12 is obscured.

Figure 4:
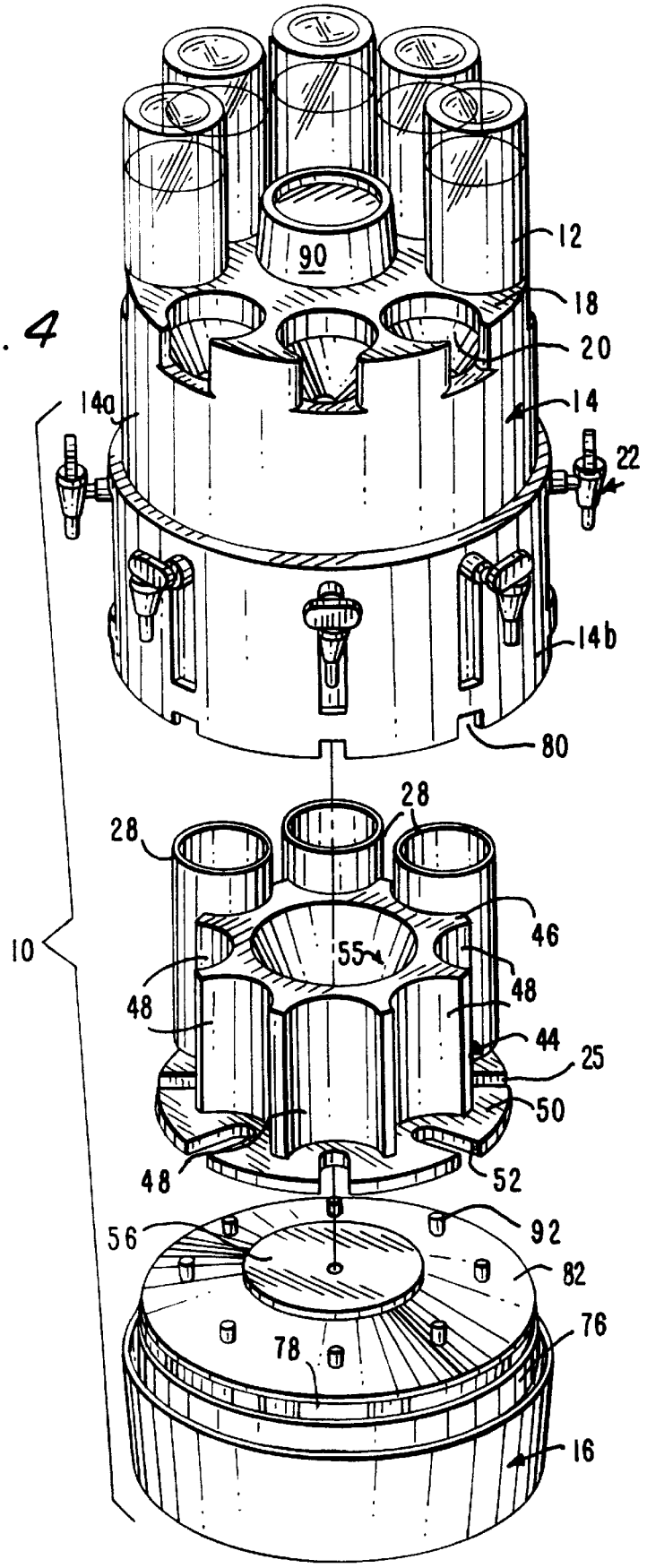
FIG. 4 is an exploded perspective view of the apparatus for dispensing beverages in accordance with the invention with several bottles and canisters removed.

As shown in FIGS. 3 and 4, compartment-forming means, namely open top canisters 28, are arranged in the housing 14, each comprising a substantially cylindrical body defined by a tubular side wall 30 including an aperture 32 and a lower wall 34 closing a bottom end of the side wall 30 and including an aperture 36. Each canister 28 underlies one of the recesses 20 in the transverse wall 18 so that when the bottles 12 are placed into the recesses 20 in an inverted position, the beverage 38 in each bottle 12 flows therefrom under the influence of gravity into a respective canister 28 (as represented by the arrow G in FIG. 3) and is retained therein. The canisters 28 are preferably made from stainless steel or another comparable material having good thermal conductivity.

Dispensing means, namely a plurality of spigots 22, are arranged on the outer surface of the cylindrical section 14*b* of the housing 14 uniformly spaced from one another. Each spigot 22 includes an internal flow passage 23, a dispensing tube 24 in flow communication with the internal flow passage 23 and a tab or lever 26 which controls the flow of beverage through the internal flow passage 23 to the dispensing tube 26.

A pipe 40 having an internal fluid passage 42 extends between each canister 28 and the respective spigot 22. Passage 42 fluidly connects the canister 28 via aperture 32 to the internal flow passage 23 in the respective spigot 22. If desired, spigots 22 may be arranged in an alternative configuration to that shown in the drawings, such as alongside one another, by providing appropriate flow passages from the canisters 28 to the spigots 22 at the desired locations. Instead of spigots 22, other dispensing means such as a hose leading to a nozzle may be arranged in flow communication with the canisters 28.

Heat transfer and thermal sink means, namely a thermal sink member 44 made of a material having good thermal conductivity such as aluminum, is arranged in an interior of the housing 14. Thermal sink member 44 comprises a relatively massive generally cylindrical body 46 including a plurality of axially extending concavities 48 formed around its circumference (as shown most clearly in FIG. 4). The thermal sink member 44 is constructed to serve as either a heat reservoir or a cold reservoir and includes a base 50 situated at lower edge of the cylindrical body 46 which has a diameter larger than the diameter of the body 46 so that base 50 extends beyond the periphery of the body 46. Each canister 28 is situated in contacting relationship with a respective concavity 48 (via a portion of the side wall 30) and an upper surface of a portion of the base 50 adjacent that concavity 48 and extending beyond the periphery of the body 46 so that base 50 thus supports the canisters 28. Base 50 includes channels 52 extending radially inward from an outer peripheral surface, one underlying each canister 28. To reduce the bulk of the thermal sink member 44 in order to improve the cooling (or beating) effect provided by a thermoelectric unit 54 as discussed below and optimize the cooling or heating efficiency of the thermal sink member 44, the thermal sink member 44 has a substantial hollow interior region, e.g., a conical recess 55 in a middle portion thereof as shown in FIG. 4. In a preferred embodiment, thermal sink member 44 is a cast aluminum structure.

Figure 5:
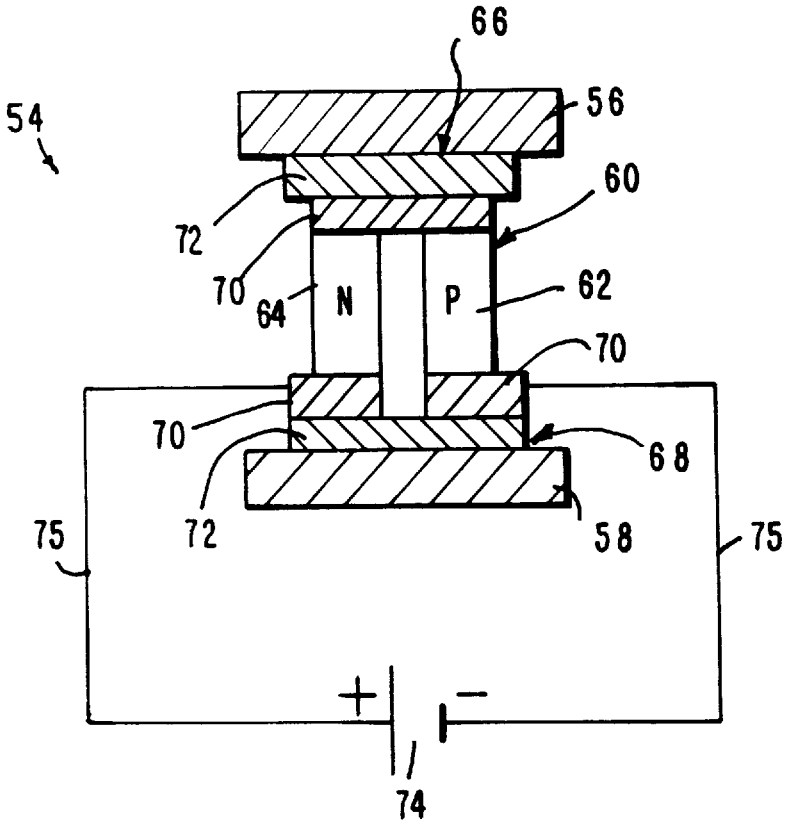
FIG. 5 is a schematic view of a thermoelectric unit used in the apparatus for dispensing beverages in accordance with the invention.

The thermoelectric unit 54 is arranged in a lower portion of the interior of the housing 14 and includes a pair of conductor plates 56,58 made from a thermally conductive material and one or more thermocouples 60, each including a pair of semi-conductor elements 62,64 made from a semi-conductor material such as bismuth-telluride-selenide and bismuth-antimony-telluride alloys (FIG. 5).

Conductor plate 56 is thermally coupled to the canisters 28 through thermal sink member 44. In particular, the conductor plate 56 is thermally connected by thermo-conductive epoxy to the base 50 of the thermal sink member 44 to facilitate the transfer of thermal energy between the conductor plate 56 and the thermal sink member 44 and the canisters 28 are thermally connected by thermo-conductive epoxy to the thermal sink member 44 to facilitate the transfer of thermal energy between the canisters 28 and the thermal sink member 44. On the other hand, conductor plate 58 is thermally isolated from the canisters 28.

As shown in FIG. 5, the conductor plate 56 comprises a first "junction surface" 66 and the conductor plate 58 comprises a second "junction surface" 68. A p-type semi-conductor 62 and an n-type semi-conductor 64 are connected between electrical conductors 70, and electrical insulators 72 are interposed between the conductor plates 56,58 and the electrical conductors 70. A voltage is applied to the semi-conductor elements 62,64 from a source 74 through wires 75. In accordance with the principles of thermoelectric generation, at one junction surface, heat is converted into an electrical effect and the temperature of the conductor plate associated with this junction surface will decrease, i.e., it will be cooled, whereas at the other junction surface, the electrical effect is converted into heat and the temperature of the conductor plate associated with this junction surface will increase, i.e., it will be heated. In other words, heat is "pumped" or transferred from one junction surface to the other through the generation of the electrical effect. The rate of heat transfer is proportional to the current applied to the circuit. The heating or cooling of the conductor plates 56,58 depends on the direction of the current through the circuit and in the embodiment shown in FIG. 5, the conductor plate 56 will be cooled and conductor plate 58 will be heated. In this case, conductor plate 58 serves as a heat sink. Reversing the placement of the electrodes of the voltage source 74 will result in the current traveling in the opposite direction in which case, the conductor plate 56 will be heated and the conductor plate 58 will be cooled. However, a change in the direction of the current through the circuit does not necessarily involve a change in the connection of the wires 75 to the electrodes of the voltage source 74 and may be accomplished by altering the current path through the thermoelectric unit 54, e.g., by means of a switch (not shown). The thermoelectric unit 54 may be any commercially available thermoelectric unit, e.g., one formed of one or more thermoelectric thermocouples made from two elements of semiconductor material which are doped to create either an excess (n-type) or deficiency (p-type) of electrons.

The thermoelectric unit 54 is mounted in a frame 76 which includes ducts 78 leading to vents 80 situated in the outer surface of the cylindrical section 14*b* of the housing 14. A thermal insulating member 82, such as a polyurethane foam baffle, separates the frame 76 and the thermoelectric unit 54 mounted in connection therewith from the thermal sink member 44 in order to prevent heat transfer from the conductor plate 58 and the frame 76 to the thermal sink member 44 and thus the canisters 28. Thermal insulating member 82 surrounds the conductor plate 56 so that heat can only be transferred through the conductor plate 56 to or from the thermal sink member 44.

Air flow means, such as ventilation fan 84, are arranged on a housing 96 and direct air over the conductor plate 58 and frame 76 through the ducts 78 in the frame 76 and out of the interior of the housing 14 through vents 80. The ventilation fan 84 is primarily useful when the thermoelectric unit 54 is operating in the heating mode and the conductor plate 58 is heated, although it may also be used in the cooling mode.

Housing 96 contains electrical transfer components for transferring electrical power from an external source to the thermoelectric unit 54 and the ventilation fan 84. The housing 14 is connected to the electrical transfer housing 96 and the electrical transfer housing 96 is rotatably coupled to a turntable 86 fixedly mounted in the base 16 so that in use, the turntable 86 rotates the electrical transfer housing 96 and thus the housing 14 also rotates relative to the base 16. This increases the visibility and ease of use of the apparatus 10. Also, in view of the rotatability of the housing 14, all of the bottles 12 may be rotated into a dispensing position and intermittently viewed and the beverages contained therein dispensed even if the apparatus 10 is placed against a wall. Specifically, by controlling the rotation of the housing 14 relative to the base 16, it is possible to stop the apparatus when a particular spigot 22 dispensing a specific beverage is in an optimum dispensing location in order to dispense that beverage.

To maximize the heating or cooling of the beverages in the canisters 28, thermal insulation means 88, such as polyurethane foam, are arranged throughout the housing 14 around the canisters 28 and thermal sink member 44, e.g., between the canisters 28 and the inner wall of the housing 14 and between the thermal sink member 44 and the upper wall 18.

A platform 90 is connected to the upper wall 18 to provide support for an advertising display which may be mounted thereon, the advertising display possibly relating to the beverages being dispensed.

To enable draining of the beverages from the canisters 28, e.g., when changing the beverage to be dispensed from the canister 28 or cleaning the canister 28, a drain tube 92 extends from the aperture 36 in the lower wall 34 of each canister 28 through the respective channel 52 in the base 50 of the thermal sink member 44. Each drain tube 92 includes a flow restrictor 94 for restricting the flow of beverage through the drain tube during normal use of the apparatus 10. Other draining means may also be integrated in connection with the canisters 28.

In operation, bottles 12 are opened and placed in an inverted position in the recesses 20 of the transverse upper wall 18 of the housing 14 of the beverage dispensing apparatus 10 and the beverage 38 in each of the bottles 12 flows into the respective canister 28. The determination of whether the beverages are to be cooled or heated is made and the operating parameters of the thermoelectric unit 54, such as the applied current, are controlled or preset in order to cool or heat the beverages to a desired dispensing temperature. Appropriate means to ensure that the beverages cannot be dispensed until they attain the desired dispensing temperature (not shown) may be provided. Assuming the beverages are to be cooled, then the voltage is applied to the thermocouple(s) 60 in the thermoelectric unit 54 to cause the conductor plate 56 to be cooled and the conductor plate 58 to be heated, i.e., heat will be pumped from the junction surface 66 associated with the conductor plate 56 to the junction surface 68 associated with the conductor plate 58 by the application of the voltage to the thermocouple(s) 60. By means of the thermal connection between the canisters 28 and the thermal sink member 44 and the thermal connection between the thermal sink member 44 and the conductor plate 56, heat is transferred from the canisters 28 through the thermal sink member 44 to the conductor plate 56 to be pumped to the conductor plate 58 via the thermocouple(s) 60. As a result of this heat transfer, the temperature of the canisters 28 is lowered and thus the beverages contained in the canisters 28 are cooled to the desired dispensing temperature. The temperature of the thermal sink member 44 is also lowered so that the thermal sink member 44 thus serves as a cold reservoir.

Once the beverages in the canisters 28 attain the desired dispensing temperature, then it is possible to dispense the beverages from the canisters 28 by depressing the tab or lever 26 of the spigots 22. Upon depressing the tab or lever 26 of a spigot 22, the internal flow passage 23 in that spigot 22 is opened and fluidly connects the fluid passage 42 in the pipe 40 to the dispensing tube 24 of that spigot 22. The beverage 38 in the canister 28 associated with that spigot 22 then flows through the aperture 32 in the side wall 30 of the canister 28 into the fluid passage 42 through the spigot 22 and then out of the dispensing tube 24, e.g., to a glass positioned below the dispensing tube 24. A quantity of the beverage in the bottle 12 associated with that spigot 22 flows into the canister 28 to replace the dispensed volume of beverage and this process continues until the bottle is empty. Once a bottle 12 is emptied of beverage, it can be replaced by another bottle of the same beverage.

The housing 14 manually or automatically rotates so that any one of the spigots 22 is accessible and the beverage 38 contained in the canister 28 associated with that spigot 22 is dispensable.

The bottles mounted in the apparatus in accordance with the invention may contain different types of the same beverages, such as different varieties of liquor, e.g., different flavored vodka. However, it is not essential that the beverages contained in the bottles mounted in the apparatus to be dispensed thereby are liquor or another hard beverage but rather may be any beverage suitable for dispensing, including but not limited to sodas, juices, ades, mineral waters and mixers. Indeed, if the apparatus is applied to heat beverages, then the canisters may contain apple cider which is often served heated. Also, the apparatus in accordance with the invention may be used to dispense different types of beverages, e.g., liquors and sodas, in view of the presence of separate dispensing arrangements for each bottle whereby the beverages do not pass through any common conduit and their dispensing paths are completely separate from one another.

The examples provided above are not meant to be exclusive. Many other variations of the present invention would be obvious to those skilled in the art, and are contemplated to be within the scope of the appended claims. For example, it should be appreciated that although the illustrated embodiment is designed to receive eight beverage bottles or containers in a substantially circular configuration, the apparatus in accordance with the invention may be constructed to receive any number of bottles or containers in any geometric configuration without deviating from the scope and spirit of the invention. Furthermore, it is possible to utilize the overall structure of the dispensing portion of the apparatus, i.e., the arrangement of the housing with the bottle-receiving recesses, the canisters and the thermal sink member, in connection with thermoelectric cooling or heating units other than that described herein. For example, this structure may be used in connection with a thermoelectric cooling or heating unit including one or more thermocouples, one or more first conductor plates situated proximate the canisters and one or more second conductor plates spaced from a respective one of the first conductor plates. To reduce costs, only a single pair of conductor plates may be used, as in the illustrated embodiment.

I claim:

1. An apparatus for dispensing beverages from containers, comprising a housing having an outer surface, compartment-forming means arranged in said housing for receiving beverages from a plurality of beverage containers, each in a separate compartment, dispensing means mounted on the outer surface of said housing and arranged in flow communication with said compartments for enabling individual dispensing of the beverages from said compartments, and a single thermoelectric unit for cooling or heating the beverages in all of said compartments when the beverages are received in said compartments, said thermoelectric unit having a first conductor plate thermally coupled to said compartment-forming means, a second conductor plate spaced from said first conductor plate and thermally isolated from said compartment-forming means and at least one thermocouple arranged between said first and second conductor plates, each comprising a pair of semi-conductor elements made from a semi-conductor material, such that upon the application of a voltage to said at least one thermocouple, said first conductor plate and thus said compartment-forming means and the beverages contained in said compartments are cooled and said second conductor plate is heated or said first conductor plate is heated and thus said compartment-forming means and the beverages contained in said compartments are heated and said second conductor plate is cooled.

2. The apparatus of claim 1, further comprising heat transfer and thermal sink means for transferring thermal energy between said first conductor plate and said compartment-forming means.

3. The apparatus of claim 2, wherein said heat transfer and thermal sink means comprise a thermal sink member made of a thermal-conductive material interposed between said first conductor plate and said compartment-forming means and thermally connected to said first conductor plate and said compartment-forming means.

4. The apparatus of claim 3, wherein said thermal sink member comprises a substantially cylindrical body including a plurality of concavities around an outer circumference, said compartment-forming means being arranged in connection with said concavities.

5. The apparatus of claim 2, wherein said compartment-forming means comprise a plurality of canisters, each of said canisters defining one of said compartments, and said heat transfer and sink means comprise a thermal sink member made of thermal-conductive material interposed between said canisters and said first conductor plate and thermally connected to said first conductor plate and said canisters.

6. The apparatus of claim 5, wherein said thermal sink member comprises a substantially cylindrical body including a plurality of concavities around an outer circumference, each of said concavities being receivable of one of said canisters.

7. The apparatus of claim 6, wherein said thermal sink member further comprises a base having a diameter larger than the diameter of said body and being thermally connected to said first conductor plate, said canisters being supported on said base.

8. The apparatus of claim 5, further comprising a thermal insulating member surrounding said first conductor plate for isolating an area surrounding said thermoelectric unit from said thermal sink member and said canisters.

9. The apparatus of claim 5, wherein said thermal sink member comprises a cast aluminum structure and said canisters are made from stainless steel.

10. The apparatus of claim 1, wherein said compartment-forming means comprise a plurality of canisters arranged in a circular configuration, each of said canisters defining one of said compartments.

11. The apparatus of claim 10, wherein each of said canisters has an aperture in a bottom surface thereof, further comprising means for draining said compartments, said draining means comprising a drain tube connected to each of said apertures and a flow restrictor associated with each of said drain tubes for preventing draining of the beverage from said compartments during dispensing of the beverage.

12. The apparatus of claim 1, wherein said housing has an upper wall defining a plurality of bottle-receiving recesses, each of said recesses being situated over one of said compartments.

13. The apparatus of claim 1, wherein said dispensing means comprise a plurality of spigots mounted on the outer surface of said housing, each of said spigots having an internal flow passage in flow communication with one of said compartments.

14. The apparatus of claim 13, further comprising passage means for defining a flow passage from each of said compartments to said internal flow passage in a respective one of said spigots.

15. The apparatus of claim 1, wherein said housing is substantially cylindrical, further comprising a stationary base and rotation means for rotating said housing relative to said base.

16. The apparatus of claim 1, further comprising ventilation means for directing air over said second conductor plate.

17. The apparatus of claim 16, further comprising a frame arranged in said housing and including ducts, the outer surface of said housing including vents, said thermoelectric unit being mounted in said frame and said ventilation means being arranged relative to said frame such that air is directed over said second conductor plate and through said ducts and out of said housing through said vents.

18. The apparatus of claim 1, further comprising thermal insulation means arranged within said housing for preventing thermal loss between said compartment-forming means and said first conductor plate.

19. The apparatus of claim 1, wherein said housing is substantially cylindrical and includes an upper wall, further comprising a platform arranged on said upper wall for supporting an advertisement.

20. The apparatus of claim 3, wherein said thermoelectric unit is operated such that said first conductor plate is cooled whereby said thermal sink member serves as a cold reservoir, and each of said containers has a different beverage.

21. An apparatus for dispensing beverages from containers, comprising a housing having an outer surface, a plurality of canisters arranged in said housing for receiving beverages from a plurality of beverage containers, each in a separate canister, dispensing means mounted on the outer surface of said housing and arranged in flow communication with said canisters for enabling individual dispensing of the beverages from said canisters, thermoelectric means for cooling or heating the beverages in all of said canisters, when the beverages are received in said canisters, said thermoelectric means comprising a first conductor plate thermally coupled to said canisters, a second conductor plate spaced from said first conductor plate and thermally isolated from said canisters, and at least one thermocouple arranged between said first and second conductor plates, each comprising a pair of semi-conductor elements made from a semi-conductor material, and heat transfer and thermal sink means for transferring thermal energy between said first conductor plate and said canisters such that upon the application of a voltage to said at least one thermocouple, said first conductor plate and thus said canisters and the beverages contained therein are cooled and said second conductor plate is heated or said first conductor plate is heated and thus said canisters and the beverages contained therein are heated and said second conductor plate is cooled.

22. The apparatus of claim 21, wherein said heat transfer and thermal sink means comprise a thermal sink member made of a thermal-conductive material interposed between said first conductor plate and said canisters and thermally connected to said first conductor plate and said canisters.

23. The apparatus of claim 22, wherein said thermal sink member comprises a substantially cylindrical body including a plurality of concavities around an outer circumference, each of said concavities being receivable of one of said canisters.

24. The apparatus of claim 21, wherein said housing has an upper wall defining a plurality of bottle-receiving recesses, each of said recesses being situated over one of said canisters.

25. The apparatus of claim 21, wherein said dispensing means comprise a plurality of spigots mounted on the outer surface of said housing, each of said spigots having an internal flow passage in fluid communication with one of said canisters, further comprising passage means defining a flow passage from an interior of each of said canisters to said flow passage in a respective one of said spigots.

26. The apparatus of claim 21, wherein said housing is substantially cylindrical, further comprising a stationary base and rotation means for rotating said housing relative to said base.

27. The apparatus of claim 21, further comprising ventilation means for directing air over said second conductor plate, and a frame arranged in said housing and including ducts, the outer surface of said housing including vents, said thermoelectric means being mounted in said frame and said ventilation means being arranged relative to said frame such that air is directed over said second conductor plate and through said ducts and out of said housing through said vents.

28. The apparatus of claim 21, wherein said thermoelectric means comprise a single thermoelectric unit for cooling or heating the beverages in all of said canisters.

* * * * *